United States Patent [19]

DeSmet

[11] 4,268,821

[45] May 19, 1981

[54] MAGNETIC DISPLAY DEVICE

[75] Inventor: Gregory L. DeSmet, Arcadia, Calif.

[73] Assignee: Fischbach and Moore, Inc., New York, N.Y.

[21] Appl. No.: 764,633

[22] Filed: Feb. 1, 1977

[51] Int. Cl.[3] ..... G08B 5/30

[52] U.S. Cl. ..... 340/378.1; 340/373

[58] Field of Search ..... 340/378 MW, 373, 378 R, 340/336, 325; 310/67

[56] References Cited

U.S. PATENT DOCUMENTS

| | | | |
|---|---|---|---|
| 3,089,131 | 5/1963 | Morgan | 340/378 MW |
| 3,166,744 | 1/1965 | Leonchick | 340/378 MW |
| 3,289,131 | 11/1966 | Watkins et al. | 340/378 MW |
| 3,307,170 | 2/1967 | Aoyama | 340/324 M |
| 3,353,174 | 11/1967 | Lang | 340/378 MW |
| 3,375,512 | 3/1968 | Watkins | 340/325 |
| 3,573,812 | 4/1971 | Pihl | 340/378 MW |
| 3,636,557 | 1/1972 | Watkins | 340/378 MW |
| 3,798,640 | 3/1974 | Dill | 340/373 |
| 3,806,744 | 4/1974 | Abraham | 310/67 |
| 3,970,980 | 7/1976 | Nelson | 310/67 R |

*Primary Examiner*—Harold I. Pitts
*Attorney, Agent, or Firm*—Lyon & Lyon

[57] ABSTRACT

A multi-position electromagnetically actuated display element suitable for use in a matrix arrangement to display user-selected messages is disclosed. The element is indexed to display a selected face by energizing one of a plurality of stator coils, the energized coil then attracting a pole of a magnet disposed outwardly of the stator and affixed to the viewing faces. Mounting structures and drive circuitry are disclosed suitable for arranging the element in a matrix display and causing the elements in the matrix to display user-selected messages. Alternative embodiments are disclosed.

27 Claims, 13 Drawing Figures

FIG. 6.
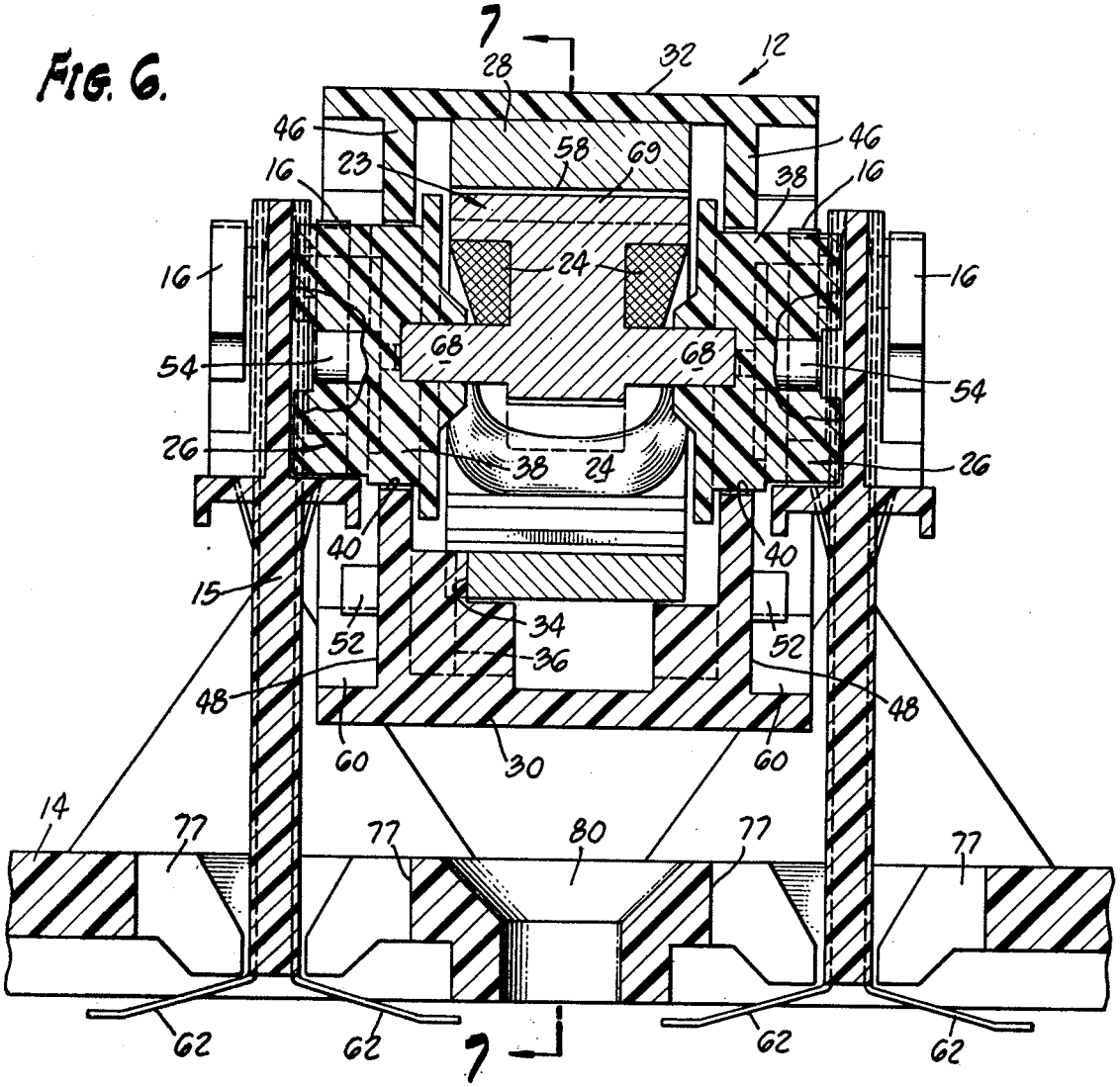
FIG. 9.
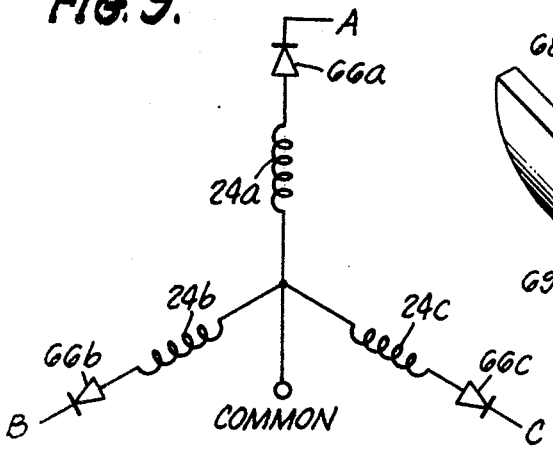
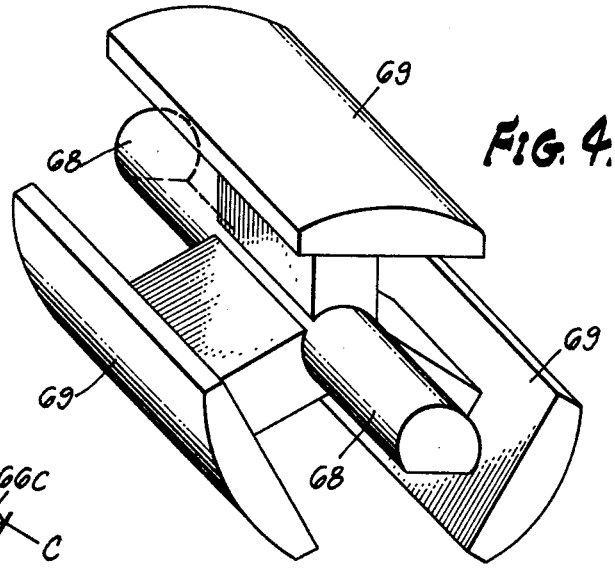
FIG. 4.

MAGNETIC DISPLAY DEVICE

FIELD OF THE INVENTION

The present invention is related generally to electromagnetic display devices, and more particularly to electromagnetic display devices suitable for use in sign displays.

BACKGROUND OF THE INVENTION

Indoor and outdoor display devices such as billboards are well known in the art. While such displays provide maximum message area for total sign area, billboards are limited in that only a single message may be conveyed unless the entire billboard is redone.

Another prior art display is shown in Ray U.S. Pat. No. 1,461,047 or Reed U.S. Pat. No. 3,199,239 and comprises a plurality of triangular elements rotatably disposed adjacent one another. The elements turn simultaneously to provide three displays, each similar to a simple billboard. While this type of display provided triple message capability, only limited flexibility is provided since each of only three messages can be displayed without refinishing the sign.

A different display system is suggested by Charles U.S. Pat. No. 874,832, in which a plurality of triangular elements are disposed in rows and columns to form a matrix, each column of elements being affixed to a spindle for rotation. However, the device is limited in that entire columns of elements, rather than individual elements, are rotated, and therefore only three messages can be displayed. Aoyama U.S. Pat. No. 3,307,170 shows a similar display which includes an electromechanical means for rotating each triangular element individually, to permit the user to selectively rotate groups of elements to display a desired message.

While the display of Aoyama U.S. Pat. No. 3,307,170 provided increased flexibility by permitting the user to selected and vary the message displayed, the electromechanical clutching and rotation devices associated with, but external to, each element for selecting the proper viewing face are of such complexity and size that repairs are difficult to make, and the structure cannot readily be incorporated in an element of small dimension. In addition, such electromechancial devices require considerable energy for operation, and the use of solenoids occasionally resulted in incomplete rotation of the elements, yielding poor resolution.

The electromechanical structure shown by Aoyama was improved upon in an invention disclosed in patent application Ser. No. 581,943, filed May 29, 1975, and assigned to F&M Systems Company, which application disclosed simplified clutching and drive mechanisms. However, even such improved systems are of such complexity that repairs can be difficult. Also, since a single rotating spindle extends through each column of elements, replacement of a single element involved substantial disassembly of the sign.

A different approach is shown in Lacy U.S. Pat. No. 3,924,226, also assigned to F&M Systems Company. Lacy discloses a display comprising a matrix of electromagnetically positioned elements, each element being housed in a liquid-filled chamber and caused to rotate by the attraction between an energized electromagnet located outside the housing and a permanent magnet or magnets located within the element itself. While this approach eliminated the need for axles, shafts, bearings, and other mounting and rotation means, use of a located-filled housing presented maintenance problems. The lack of a mounting assembly coupled to the the element resulted in poor detenting; and when the elements were arranged in a matrix display, magnetic interaction between the elements resulted in poor resolution.

Displays using incandescent lighting have found favor for such uses as time, temperature and message displays. However, such displays consume considerable amounts of energy. Further, the visibility of incandescent displays is substantially reduced in bright sunlight.

An electromagnetically actuated display element employing stators has been found to satisfactorily operate in systems using only a few elements such as meter readouts and the like. One such device is shown in Morreale U.S. Pat. No. 3,253,127, where a housing is affixed to a ring magnet and the combination thereof rotates around a five-poled stator. Application of positive and negative pulses to five coils permits a ten position digital readout. Also see Silverman U.S. Pat. No. 3,479,626, which discloses a rotary two-poled magnetic drum disposed around a twelve-poled stator. The drum is indexed by interaction of pulses applied to one or more of the stator coils, each of which is wound across a plurality of stator lobes, to display a message located on a housing attached to the magnet.

Other devices have employed configurations wherein a plurality of stationary stator coils surround a rotatable magnetic core, with the housing or other indicator affixed to the rotatable core. See, for example, Kulka U.S. Pat. No. 3,766,549, Lang U.S. Pat. No. 3,353,174 (note FIG. 3), and Watkins Pat. No. 3,412,615. Such display elements are complex and expensive to manufacture, as well as being suitable only for small displays viewed from a short distance. Such devices are not suitable for a matrix type display since the elements are of such shape and size that a matrix display would yield a very poor ratio of message area to total sign area.

It is therefore one object of this invention to provide an improved display element.

It is another object of this device to provide an improved display element suitable for use in a matrix arrangement.

It is a further object of the present invention to provide a display element which requires power only during changes in the displayed message.

It is another object of this invention to provide an improved multi-faceted display element wherein the elements for selecting the proper viewing face are substantially incorporated within the display element.

It is another object to provide a display element requiring minimal maintenance.

It is another object of the present invention to provide a substantially maintenance-free display for interior and exterior use.

It is a further object of the present invention to provide a display which does not require continuous power.

It is another object of the present invention to provide a display which provides a good proportion of message area to total sign area.

It is another object of the present invention to provide a display element which may be reliably mass produced at low cost.

It is a further object of this invention to provide a display which is readable under ambient daytime lighting.

It is a further object of this invention to provide a display which operates on low voltages.

It is a further object of the present invention to provide a display with low power consumption.

It is a further object of the present invention to provide a display element having readily disconnected contacts which are substantially weatherproof when connected.

Other and further objects of the present invention will be apparent in the course of the detailed description of the invention which follows.

SUMMARY OF THE INVENTION

The above objects are accomplished by an exemplary embodiment of the present invention through the use of a stator positioned within a magnet so that the magnet may rotate about the coil form. Affixed to the magnet is a specially configured housing having a plurality of faces suitable for viewing in a matrix display. The magnet, which in one preferred embodiment is a ring magnet, typically has at least three poles, one pole being a strong South pole, for example, while the remaining two are weak North poles.

The housing is constructed in a two-piece arrangement so that the magnet may be inserted therein and further to permit the stator to be maintained within the housing at a constant distance from the magnet. One face of the housing is provided with slots to permit each element to be readily inserted into a mounting block, a plurality of elements being inserted into each block and a plurality of blocks being configured in a matrix to provide a large scale display.

The stator, around which the housing and magnetic structure rotate, is comprised of end caps and a coil form which has three poles in a preferred embodiment, a coil being wound on each pole. The end caps are positioned on each end of the coil form. Positioned on the end caps are a plurality of diodes, there being one diode connected in series with each coil. Also located on the end caps are barrel contacts, connected to the diodes and coils. The barrel contacts fit into electrical contacts located on the mounting block, and connect each diode and associated coil to remotely located drive circuitry. The barrel contact and corresponding mounting block contacts are configured in such a manner that, once the display element is positioned in the mounting block, a substantially gas proof seal is formed between the barrel contact and mounting block contact, making an electrical connection which is substantially impervious to adverse environmental conditions.

The ring magnet used in one preferred embodiment has a plurality of protuberances extending inwardly, there being one protuberance for each magnetic pole. The magnetic poles of the magnet are located on the protuberances to provide an improved torque to watt ratio, as well as good detenting. The protuberances are small enough to provide a relatively constant air gap between the stator and the magnetic structure. The poles on the stator preferably correspond to the number and position of the magnet protuberances. Because of the magnetic attraction between the stator poles and the protuberances, the selected face tends to remain in the viewing position despite externally applied perturbations such as wind, vibration and the like.

The present invention improves maintainability of a matrix type display since the element itself has only one moving assembly, that being the magnetic structure and the housing affixed thereto. Further, the two housing portions seal around the coil form in such a manner that environmental effects are substantially excluded from the interior of the display elelent, thereby improving the reliability of the element. In addition, the stator end cap is provided with a triangular hub which permits simple insertion and removal of any element in the display.

In normal operation, a drive circuit which utilizes row-column addressing applies a pulse to the mounting block contacts and barrel contacts of the addressed element, causing a coil to energize. The energized coil is then attracted to the strong South pole of the ring magnet, which causes the housing to rotate 120° in either direction (or 0° if no rotation is required) to cause the selected viewing face to be rotated into a viewing position. By arranging a plurality of display elements in a matrix, and coloring two of the housing faces contrasting colors (e.g., yellow and black), the display elements can be arranged to display characters or complete messages. A single character may be five elements wide and seven elements high.

Because the display elements are selectively rotated according to the electrical pulses applied thereto, the controlling circuit may be remotely located. In a preferred embodiment, a diode is associated with each coil to prevent energization of other than the addressed coils. Further, because the individual elements may be rotated to display new characters and the like, the displayed message may be easily changed at the discretion of the user. Since only two contrasting faces of the display element are required to display alphanumeric characters, the third side of each element may be dedicated to a more complex display such as a multicolored scene, or may be configured to provide a different font.

An additional feature of the present invention is that no electrical power is used between message changes. Because of the correspondence between the protuberances on the ring magnet or other magnetic structure and the poles on the coil form, the display element remains in position indefinitely even after power is disconnected. Thus, the system of the present invention can provide more than a ninety-five percent energy savings relative to the incandescent displays of the prior art. Since high contrast colors may be used for the message and background portions of the display, and at a good ratio of message area to total sign area, only low levels of incident light must be provided for night viewing, without need of disturbing fluorescent colors and the like.

IN THE DRAWINGS

FIG. 4 illustrates the coil form used in one preferred embodiment of the invention.

FIG. 6 illustrates a cut-away side view of the display element arranged in the mounting block.

FIG. 9 illustrates the interconnection of the coils on the coil form and the associated diodes.

Figure 11A:
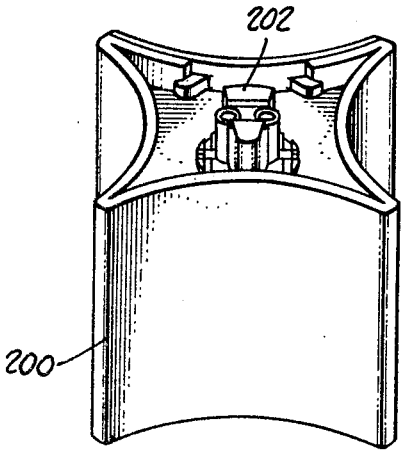
FIG. 11 illustrates in perspective view a housing suitable for use as a four sided embodiment of the present invention.
Figure 11B:
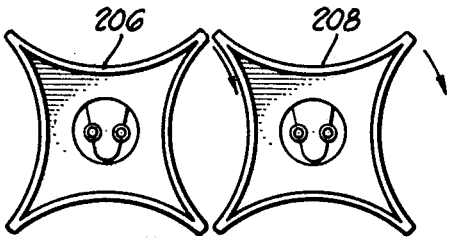

FIG. 11*b* illustrates in plan view a pair of the four sided housings shown in FIG. 11*a*.

DESCRIPTION OF THE PREFERRED EMBODIMENTS

Figure 1:
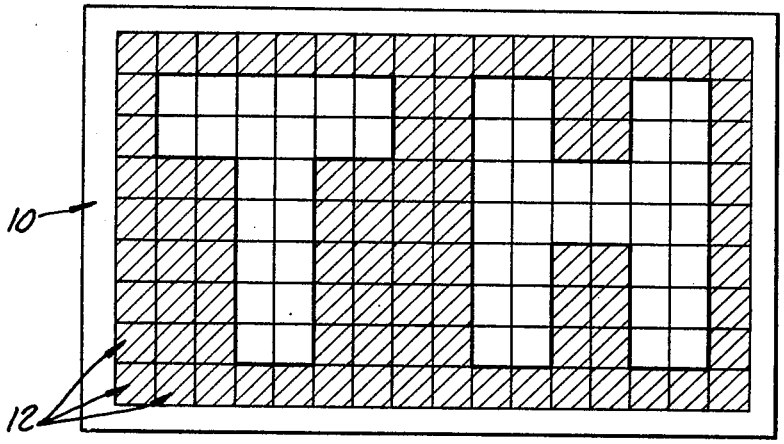
FIG. 1 illustrates a matrix of display elements arranged to display a message.

Referring now to FIG. 1, there is shown therein a display 10 comprised of a plurality of individual display elements 12 arranged in a matrix of rows and columns. Certain of the display elements 12 are arranged to show a face of one color (hatched area) such as black while other elements are rotated to display a face of a contrasting color, for example, yellow, to display characters ("T", "H"). While the display shown in FIG. 1 is a matrix of nine rows and sixteen columns, a typical display may include over one hundred columns and twenty-seven rows of display elements.

Figure 2:
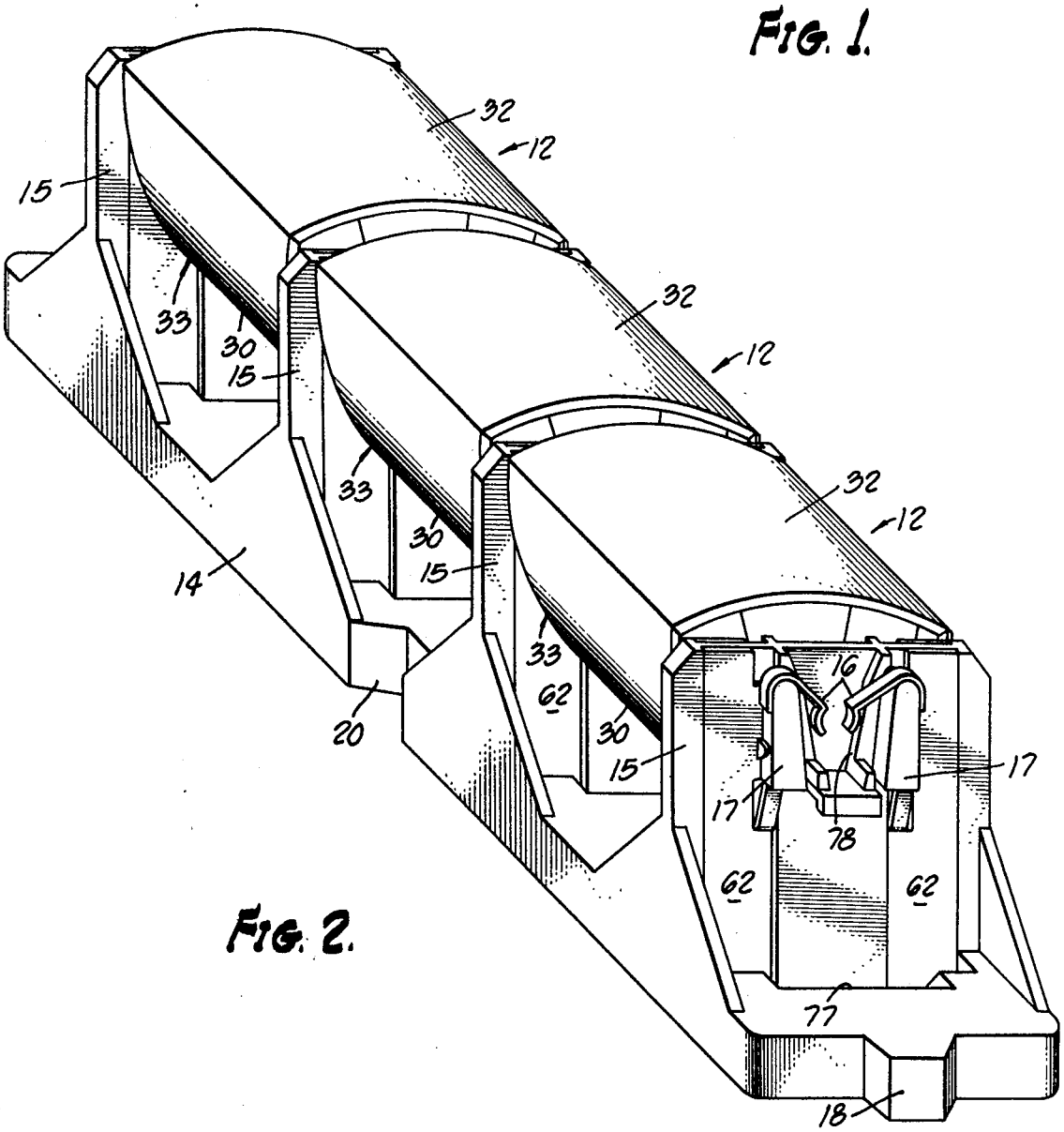
FIG. 2 illustrates three display elements of a preferred embodiment disposed in a mounting block.

Referring now to FIG. 2, there is shown therein one embodiment of an assembly of three display elements 12 of FIG. 1 mounted in a mounting block 14. Each of the elements 12 may range in size from one-half to several inches high. As will be disclosed hereinafter, the triangular elements 12 shown in FIG. 2 are rotatably fastened to stanchions 15, which are part of the mounting block 14, through the use of electrically conductive clips 16. The mounting block 14 is typically comprised of a corrosion-resistant plastic material having sufficient rigidity to support the display elements mounted thereon, as well as insulating the mounting clips 16 (typically copper or other electrical conductor). Spur 18 and notch 20 are provided to permit interlocking connection between mounting blocks to provide a large scale display similar to that shown in FIG. 1. A plurality of mounting blocks 14 as shown in FIG. 2 are typically affixed to a substrate (not shown), to form a mounting block assembly which may provide mounting locations for forty or more rows and columns of display elements, i.e., a forty-by-forty matrix of display elements. Electrical contacts are provided on the substrate to connect to the mounting clips 16, as will be clearer from FIG. 6.

Figure 3:
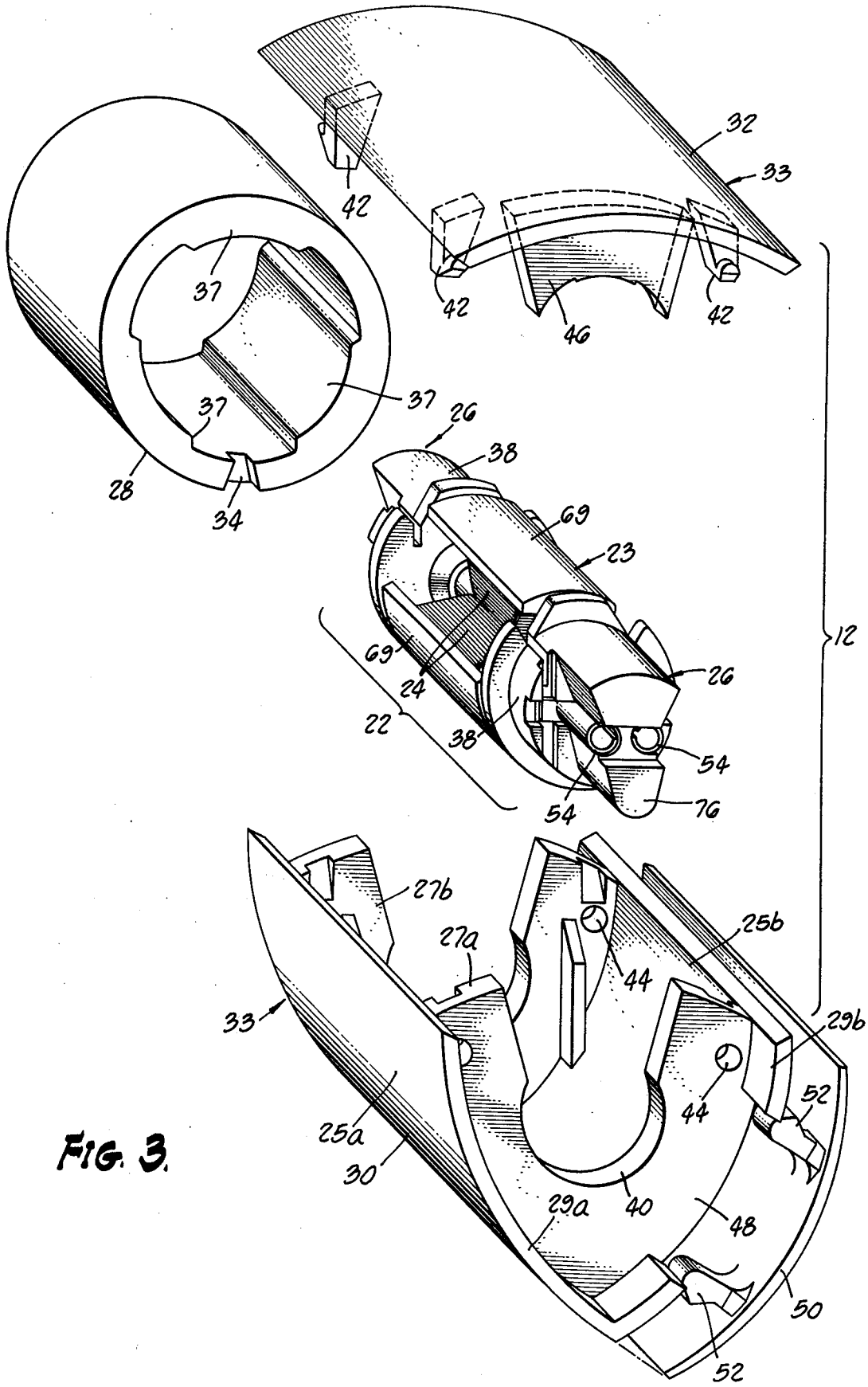
FIG. 3 illustrates an exploded view of one preferred embodiment of display element.

Referring to FIG. 3, one display element 12 is shown in an exploded view to permit examination of the interrelationships between the components thereof. It can be seen that the element 12 comprises a stator 22 having a pair of end caps 26 affixed to a coil form 23 on which are wound a plurality of coils 24. A pair of electrically conductive barrel contacts 54 are located on each of the end caps 26 for a purpose described later.

The stator 22 fits within a ring magnet 28, and the combination thereof fits into a base 30, which together with a cover 32 form a housing 33. The cover 32 fastens to the base 30 to position the stator 22 within the housing 33. The base 30 comprises a pair of viewing faces 25*a* and 25*b* connected to a pair of parallel supporting plates 27*a* and 27*b* which extend between the faces 25*a–b* and orthogonally thereto. Each of the faces 25*a–b* further include flanges 29*a* and 29*b* extending from junction of the faces 25*a–b* and the plates 27*a–b* to (as better shown in FIG. 4) just below the top of the end caps 26. The cover 32 provides a third face with analogous flanges. While the flanges 29*a–b* are clearly shown in FIG. 3 on only one end of the faces 25*a–b*, it is to be understood that these flanges 29*a–b* extend from both ends of the faces 25*a–b* (see FIG. 4). The ring magnet 28 has a notch 34, which is slightly wider at the outside diameter than at the inside diameter of the magnet 28, which mates with a ridge 36 (not shown in FIG. 3 but illustrated in FIG. 5) on plate 27*a* of the base 30 to fix the position of the ring magnet 28 relative to the base 30. The ring magnet 28 further has three inwardly extending protuberances 37 which correspond in position to the poles of the coil form 23, as will be discussed hereinafter.

The end caps 26 of the stator 22 include hubs 38, which fit into circular notches 40*a* and 40*b* in the plates 27*a* and 27*b*, respectively, of the base 30. Once the assembly of the ring magnet 28 and stator 22 have been located in the base 30, the cover 32 is fastened to the base 30 by application of pressure thereto which causes projections 42 on the cover 32 to catch in holes 44 on the base 30. A pair of projections 46 extend inwardly from the cover 32 and are spaced to coincide with the plates 27*a–b* of the base 30 to seal around the hubs 38 on the stator 22, the end of each projection 46 being rounded to conform to the circular hubs 38. The length of the cover 32 corresponds to the length of the faces 25*a–b*, including flanges 29*a–b*, so that a relatively flush mounted assembly results when the cover 32 is fastened to the base 30. It should be understood that the circular notches 40*a–b*, and the rounded end of the projections 46, are of a dimension relative to the hub 38 which will permit the housing 33 to freely rotate about the stator, while establishing a slight seal therebetween for protecting the internal portion of the stator from particles and the like.

Each of the two flanges 29*b* (only one shown) on face 25*b* of the base 30, is provided with a notch 48, which permits the assembly of the stator 22 and housing 33 to be mounted in the mounting block 14 as will be discussed in connection with FIG. 9. Once the stator-and-housing assembly is positioned in the mounting block 14, a removable cap 50 is affixed to the face 25*b* at the notches 48 by means of four spurred projections 52. One pair of spurred projections 52 is associated with each notch 48, one projection 52 of each locking to opposing edges of the notch 48.

Typically, the base 30, cover 32 and removable cap 50 are molded of a glass filled plastic such as Norel by injection molding or other suitable process. The coil form 23 is typically of injection molded ferrous material, and the end caps 26 are typically an insulating material suitable for use as a bearing such as teflon-loaded polysulfone plastic or the like.

Referring to FIG. 4, there is shown therein a coil form 23 suitable for use with the three-faceted display element shown in FIG. 2. For the exemplary embodiment disclosed herein, the coil form 23 is comprised of a shaft 68 about which are three equally spaced (i.e., 120°) poles 69. It should be noted that the coil form 23 shown in FIG. 4 is typically mass produced by injection molding methods to yield a reliable structure at an economic price. The shaft 68 is commonly referred to as a "D" shaft, or having a "D" shaped cross-section at each end. The end caps 26 are press fit onto the ends of the "D" shaft 68 so that no slippage occurs between the shaft 68 and end caps 26. To maintain substantially the same geometry for each coil, the three coils 24 are preferably wound simultaneously on the coil form 23 by any of the methods known in the art. It should further be noted that uniform concentricity of the ferrous coil form 23 is important to provide good stability when power is not applied to the coils 24 since a uniform gap 58 between the three poles 69 and the three protuberances 56 of the magnet 28 (FIG. 7) provides optimum stability. Such uniformity of concentricity also provides good detenting of the display element 12 during rotation of the element.

Figure 5:
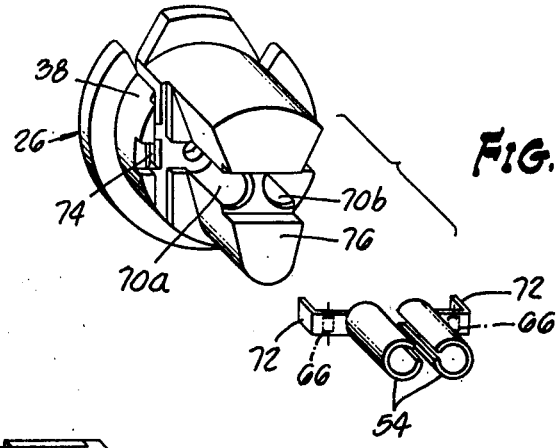
FIG. 5 illustrates the end cap used with the coil form shown in FIG. 4.

Attention is now directed to FIG. 5, which illustrates in exploded view the end cap 26 and the barrel contacts 54 normally attached thereto by connection through shafts 70*a* and 70*b*. Tabs 72 on each of the barrel contacts 54 fit into slots 74 on the end cap 26 to further fasten the barrel contacts to the end cap. Two diodes 66 are attached to the tabs 72, one diode 66 being attached to each tab. The diodes 66 are glass passivated, with both terminals thereof being plated with electrically conductive material. The cathode of each diode 66 is bonded with a conductive epoxy to the respective tab 72, and the anode of each diode 66 is connected to the associated coil 24. No diode is attached to the tab 72 which provides the common connection between the coils 24. The end cap 26 also provides a circular hub 38 for insertion into the base 30 and cover 32 as shown in FIG. 3. Extending outwardly from the hub 38 is a triangular guide 76 which serves to guide the end cap and associated stator 22 into the clips 16, as shown in FIG. 9. The end cap 26 is affixed to the shaft 68 (as was shown in FIG. 4) such that the apex of the triangular guide 76 bisects the angle between two of the poles 69 on the coil form 23, as better shown in FIG. 7.

Referring now to FIG. 6, there is shown therein a cross-sectional side view of the display element 12 mounted in the stanchions 15 of the mounting block 14. The end caps 26 are shown affixed to the coil form by a press-fit attachment, each end cap 26 having a recess (not shown) shaped to conform to the ends of the coil form 23. The combination of the end caps 26 and coil form 23, which together with the coils 24 comprise the stator 22, are mounted in a stationary position in the stanchions 15, where the barrel contacts 54 fit into clips 16. The ring magnet 28 surrounds the stator 22 and is in turn enclosed within the housing 33, to which it is attached as discussed in connection with FIG. 3. An air gap 58 of substantially uniform dimension is seen to exist between the ring magnet 28 and the coil form 23, to permit easy rotation of the ring magnet 28 and attached housing 33 when a coil is energized, while still providing good detenting and stability when power is not applied.

Also shown in FIG. 6 is one of the notches 48 in the flange 29*b* of the housing 33 which permits the assembled display element 12 to pass over the clips 16 and shoulder 17 while substantially filling the space between the stanchions 15, to maintain a good ratio of message area to total sign area. As seen from FIG. 4, the end caps 26 extend only slightly beyond the flanges 29, to permit free rotation of the display element 12 while mounted. It should further be noted that each side of a stanchion 15 supports a pair of clips 16 and supporting shoulder 17, so that the end of a first display element is separated from the end of the next element substantially only by the thickness of the stanchion 15, further improving the message area of the display. Each of the clips 16, which connect to the four barrel contacts 54 of the display element 12; extend downwardly along the mounting stanchions 15 to form connecting tabs 62 which connect to the drive circuitry discussed hereinafter. As discussed in connection with FIGS. 6 and 9, each clip 16 is electrically independent as is each barrel contact 54. Thus a total of four connections to the display element 12 are possible.

Figure 8:
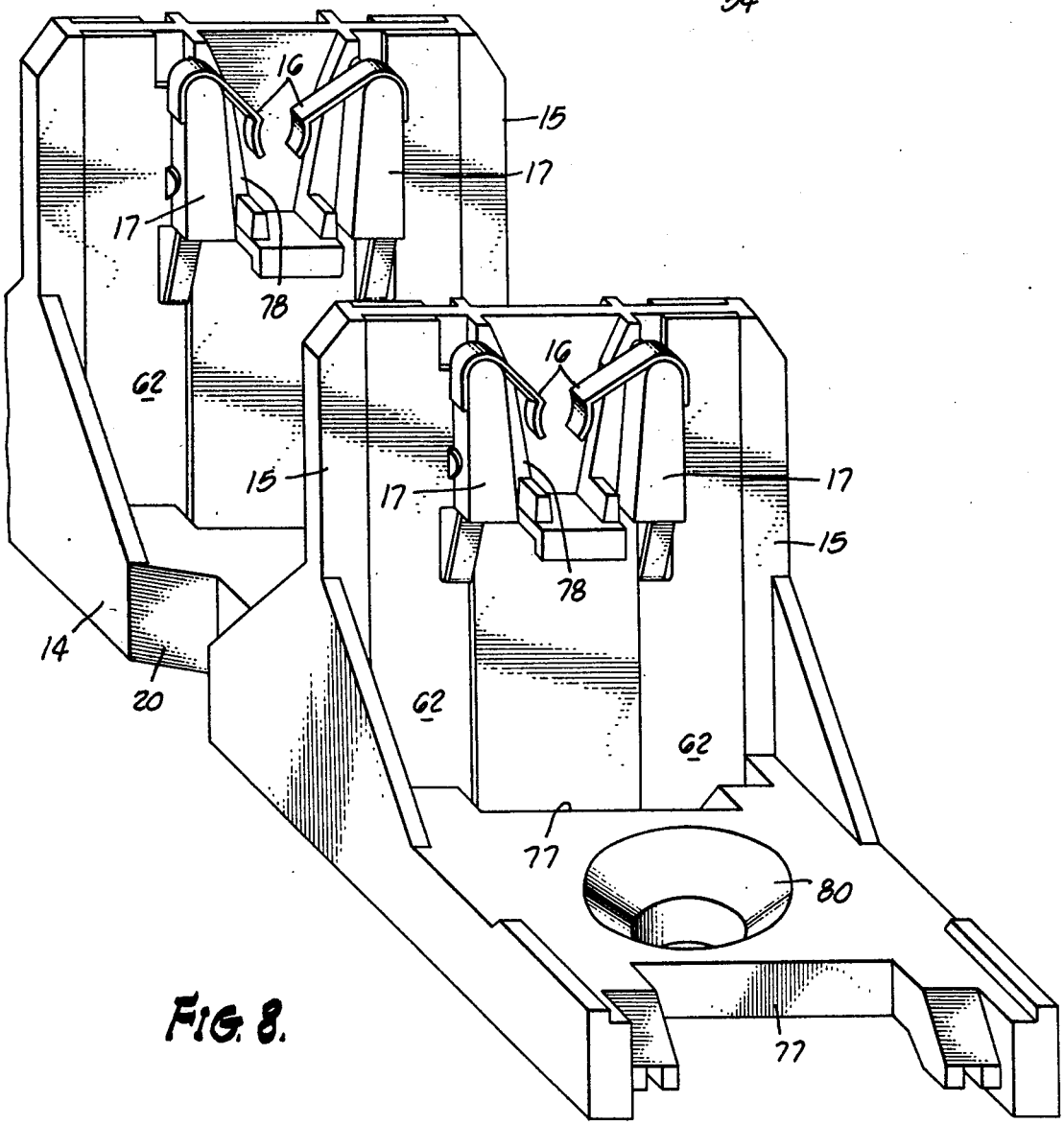
FIG. 8 illustrates in detail a portion of the mounting block into which the display element is placed.
Figure 7:
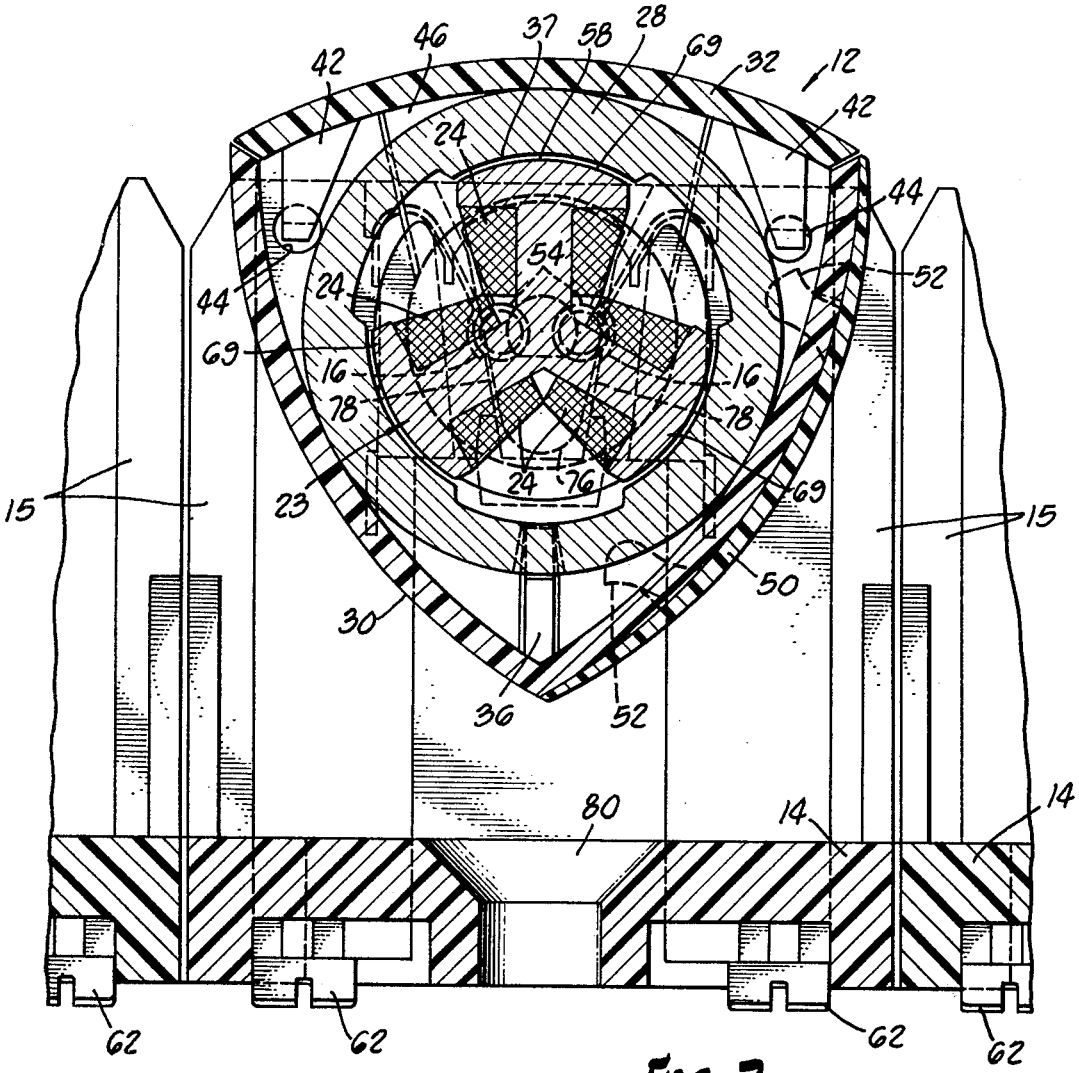
FIG. 7 illustrates a cut-away plan view of a display element in the mounting block.

Reference is now made to FIGS. 7 and 8. FIG. 7 illustrates a cutaway plan view of the display element 12 mounted in the stanchions 15 of the mounting block 14 shown in detail in FIG. 8. The electrically conductive clips 16, which are shown connected to the barrel contacts 54, have curved tips which conform to the barrel contacts 64. With most element sizes the clips 16 provides sufficient force against the barrel contacts 54 to form a gas tight seal therebetween; when insufficient pressure is provided by the clips 16, the barrel contacts 54 and the clips 16 may be plated with a precious metal to prevent corrosion. The ring magnet is shown in one of three "home" positions wherein each of the three poles of the coil form 23 comes to a rest opposite one of the protuberances 56 on the ring magnet 28. The ring magnet 28 assumes this position even when power is not applied to the coils on the stationary stator 22 because of the increased flux between the poles of the coil form 23 and the protuberances 56.

The housing 33 positions the ring magnet 28 about the stator 22 so that a relatively constant air gap 58 exists between each pole of the coil form 23 and the proturberances 56 of the ring magnet 28 to ensure that each of th three "home" positions is equally preferred. This together with the fact that the protuberances 56 extend only a small amount inward relative to the inside diameter of the remainder of the ring magnet 28, facilitates easy rotation of the hosing 3 when one of the coils 24 is energized. Thus a good torque -to-watt ratio is provided.

FIG. 7 also shows the mounting of the cover 32 on the base 30 wherein the projections 42 on the cover 32 snap into the holes 44 on the base 30. Similarly, the removable cap 50 connects to the base 30 at the notches 48 through spurred projections 52 shown in phantom in FIG. 7. Finally, FIG. 7 shows the mating between the notch 34 on the ring magnet 28 and the ridge 36 on the base 30. The ridge 36, together with the inside shape of the housing 38, serve to fix the position of the ring magnet 28 within the housing 33, so that any rotation of the magnet 28 causes an equal rotation of the housing 33.

As was discussed in connection with FIG. 5, the end cap is affixed to the shaft 68 of the coil form 23 so that the apex of the triangular guide 76 bisects the angle between two of the poles 69. As can be seen from FIG. 7, and is further discussed in connection with FIG. 8, the apex of the triangular hub points into the mounting block 14. Since it is desirable to have one entire face 29 of the housing 33 disposed for viewing, this requires the apex of the guide 76 to point toward a vertex of the triangular housing 33, again shown in FIG. 7. Therefore the protuberances 56 on the ring magnet 28 should be aligned with the housing 33 os that the magnetic attraction between the poles 69 and protuberances 56 will cause the housing 33 to rotate to a "home" position wherein an entire face 29 is displayed.

The above relationship of the triangular guide 76 and the housing 33 means that the apex of the guide 76 will point slightly away from the notches 48 on the housing 33. However, the element 12 is mounted in the mounting block 14 by aligning the notches 48 in the face 29*b* of the housing 33 with the clips 16 and shoulders 17 on the mounting block 14, so the "home" position for the guide 76 is ot the optimum position for mounting. Despite this, the element 12 readily slips into the clips 16 because of the shape of the triangular guide 76. When the element 12 is inserted between the stanchions 15, the base of the guide 76 contacts the clips 16 (see FIG. 8) before the apex of the guide. This causes the stator 22 to rotate away from its "home" position until the apex of the guide points in the proper direction and the barrel contacts 54 snap into the clips 16.

When the element 12, now mounted, is released, magnetic attraction causes the housing to return to one of the three "home" positions. The housing 33 may then be rotated to expose the notches 48 on the face 29*b*, and the removable cap 50 attached. The removable cap 59 aids in preventing an accidentally dislodged element 12 from falling out of the display, and also covers the notches 48 to provide the message area provided on the remaining two faces of the housing 33.

Reversal of the above process may be used to remove the element 12 from the mounting block 14. Slight pressure at the edge of the visible face will cause the element to rotate so that a vertex of the housing 33 may be grasped even in the midst of a large display matrix. This will permit the notches 48 to be aligned with clips 16 and shoulders 17, allowing the display element 12 to be removed. This simplified mounting and removal process serves to reduce maintenance costs for the display, and reduces the training required for maintenance personnel.

FIG. 8, which illustrates in broken section a portion of the mounting block 14 shown in FIG. 2, shows in greater detail than FIG. 2 the shoulders 17 on which the clips 16 are mounted for connection to the display element 12. The exemplary mounting block 14 shown in FIGS. 2 and 8 is suitable for housing three elements 12, plus providing half of the mounting structure necessary for elements at each end of the mounting block shown in FIG. 2. The end caps of such adjacent elements are fastened into adjoining mounting block of similar shape. Thus, a continuus row or column of elements 12 may be arranged, utilizing notches 20 and 77 together with spur 18 (see FIG. 2) and another spur (not shown) which fits into notch 29 to facilitate interlocking. The mounting block 14 is typically affixed to a substrate by the use of screws (not shown) inserted through screw holes 80 (FIG. 2), although any other suitable mounting means is acceptable. As previously noted, while the mounting block shown houses three elements, other mounting blocks may house, for example, a matrix of forty rows and forty columns of elements.

Referring to FIG. 9, there is shown therein the circuitry contained with each stator 22, i.e., the arrangement of the diodes 66 and the coils 24. The coils 24 are shown interconnected at a common node 64, and each coil 24, specifically 24*a*, 24*b* and 24*c*, are shown connected in series with diodes 66*a*, 66*b* and 66*c* respectively. The coils 24 are connected to the anodes of the diodes 66, with the cathodes thereof connected to the drive circuitry as shown in FIG. 10.

The diodes 66*a-c* are provided to prevent drive currents used to address a given coil from "backing up" through other coils in the matrix, thereby energizing them and causing undesired rotation of the associated display elements 12. FIG. 10 more clearly shows the current paths which necessitate the use of diodes 66 or similar unidirectional current flow devices. For the embodiment shown, one diode 66*a* is located on one of the barrel contacts 54 on one end cap 26, and the remaining barrel contact provides the common node 64. The remaining two diodes 66*b* and 66*c* are located on the remaining end cap 26, one being located on each barrel contact 54 as shown in FIG. 5. As will be discussed in connection with FIG. 10, a particular coil is energized by applying a current pulse to the common terminal 64 and selectively currentsinking the remaining terminal of the proper coil.

Figure 10:
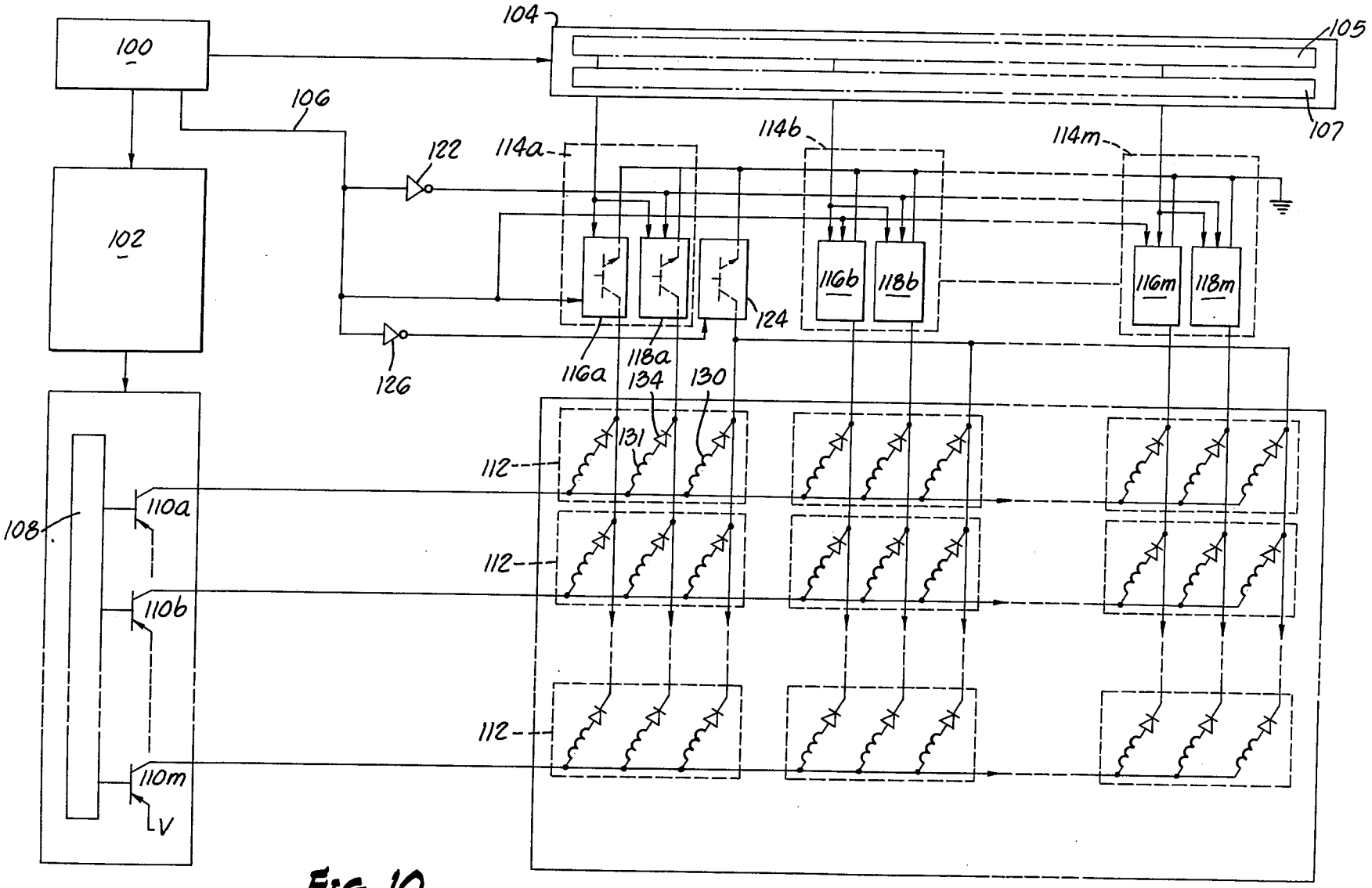
FIG. 10 illustrates the drive circuitry for use with the three facted embodiment shown in FIG. 2.

Reference is now made to FIG. 10, which illustrates drive circuitry suitable for controlling a plurality of the display elements described above arranged in a matrix as shown in FIG. 1. The drive circuitry shown in FIG. 10 comprises a data entry and storage device 100 which includes input circuitry such as a keyboard for operation by the user together with a storage unit and microprocessor for formatting and sequencing to control the characters displayed; i.e., to select the message. The microprocessor typically provides sufficient storage to provide many stored messages.

The data entry and storage device 100 provides coded signals to a row address decoder 102 and a column address circuit 104, and also provides an enabling signal 106. The row address decoder 102 provides the signal to a row driver circuit 108, which in turn provides base drive to a plurality of pnp driver transistors 110*a* and 110*n*, where N indicates the number of rows in the matrix. The emitters of each of the transistors 110 are connected to a positive voltage supply. The collectors of the transistors 110 provide a current drive to one row of the coils 24, with the circuit of FIG. 9 being shown in a slightly rearranged from in FIG. 10 as circuit 112. The collector of each row driver transistor 110 connects to the common terminals of the associated row of circuits 112; that is, connects to terminal 64 of the circuit shown in FIG. 9.

The column address circuit 104 includes a shift register 105 having M bits, where M equals the number of columns in the matrix of the display and M latch circuits 107*a-m* one latch 107 being associated with each shift register bit. A typical matrix display may have as many as 120 columns and 27 rows, for an $M \times N$ matrix of $120 \times 27$. Since a mounting block assembly may carry a matrix of twenty-seven rows and forty columns, it can be seen that the entire display is a plurality of mounting block assemblies, for example three assemblies long and one assembly high.

The shift register 105 of the column address circuit 104 is typically a serial input, parallel output device wherein every register bit may be parallel loaded into a latch associated with each register bit, such as the RCA 4094. Each latch 107*a-m* provides an input to a column driver circuit 114 comprised of a "nand" gate 116 and an "or" gate 118. Both the "nand" gate 116 and the "or" gate 118 are open collector devices suitable for providing large currents such as the Sprague 5703 and 5707 devices. The devices 116 and 118 should be thought of more as current drivers than as logic gates since no pull up resistor is tied between the output of the devices and the positive supply voltage.

Keeping in mind the role of the nand gate 116 as a current driver, one input thereto is provided for the enable signal 106 provided by the data entry device 100, and the remaining input is provided by the column address circuit 104. At the output stage of the "nand" current driver 116, wherein the output transistor is shown in phantom, the collector thereof connects to the first diode-cell combination of all of the circuits 112 and in column 114*a*. Similarly, the output transistor of the "or" gate 118 is shown in phantom, with the emitter thereof connected to ground, and the collector thereof connected to the second diode-coil combination in each of the circuits 112 in column 114*a*. It is to be understood from the foregoing that the column driver circuits 114*b* through 114*m* are identical to the column driver circuit 114*a*, with the associated "nand" gates 116*b* through 116*m* and "or" gates 118*b* through 118*m* shown in block diagram form.

The enable signal 106 is used to cause the third side of the display to rotate into the viewing position by energizing the third diode coil combination and at the same time disabling the first two coils of each circuit 112. As previously noted, the enable signal 106 provides one input to the nand 116*a* through 116*m*, and further provides a signal to or gates 118*a* through 118*m* via inverter 122. When the third coil is to be energized, the signal on the enable line 106 disables the outputs of the "nand" drivers 116*a-m* and "or" drivers 118*a-m*. Since these drivers have open collector outputs, the collectors thereof "float".

The third side of the display element 12 is typically used as a "dedicated" display, wherein a complete picture is displayed similar to the conventional billboard. As such, all of the elements 12 in the entire matrix will be rotated to display the third side of the housing 33. Thus, the third coil in each element of the matrix can be powered through a single driver, such as Darlington driver 124, the output transistor of which is shown in phantom in FIG. 10. The input to the Darlington driver 124 is provided by an inverter 126, which may be of the open collector type having a pull-up transistor connected to a positive voltage (not shown).

Should a dedicated display not be desired, the third face may be used to provide a different character font, such as script. In such a case the third coil of each element must be individually addressable as with the other two coils. It is believed that the above disclosure is sufficient to permit those skilled in the art to modify the drive circuitry shown in FIG. 10 to include the alternative embodiment of the invention.

In operation, the circuit shown in FIG. 10 provides signals to the elements in the display matrix as follows. The user enters the desired message in keyboard of the data entry device 100, which causes the M bits of information required for the first row of elements to be serially entered into the shift register 105. Once these M bits have been entered serially, which takes only a few milliseconds, the data is shifted in parallel out of the register 105 and into the associated latches 107*a–m*. During this time, the enable signal 106 is in the enable state, or a high level as shown in FIG. 10. This permits the data bits stored in the latches to set the "nand" drivers 116*a–m* and "or" drivers 118*a–m* to the requisite state for selecting the proper viewing face of the element associated with each of the circuits 112.

Once the column address is set, the row address circuit 102 is energized to permit the row driver circuit 108 to energize a selected driver transistor 110*a–m*, for example driver transistor 110*a*. Only one row driver transistor is turned on at any time. When the driver transistor 110*a* saturates, or turns on, a circuit is completed between the voltage supply connected to the driver transistor 110*a*, through the selected diode-coil combination, through the selected output transistor of the "nand" driver 116 or "or" driver 118, to ground. Completion of the circuit causes the appropriate coil in the circuit 112 to energize, attracting the proper pole in the ring magnet 28 shown in FIG. 3, so that the corresponding viewing face is displayed. It can be seen from the above that the matrix of the display is therefore rotated an entire row at a time, rather than one element at a time. Of course, some elements may already be in the desired position, in which case that element will not rotate.

While the first row of elements is rotating in accordance with the information stored in the latches 107*a–m* the data entry and storage device 100 serially enters into the shift register 105 the data bits for addressing the second row of elements in the matrix. Thus, by the time the first row of elements settles into proper position, the M bits of information needed for the second row is already entered into the shift register 105 for entry into the associated latches 107. When the elements in the first row have completed rotation all of the driver transistors 110*a* through 110*n* are turned off.

Thereafter, the data entry and storage device 100 causes the information stored in the register 105 to be loaded into the latches 107, and thereafter turns on the row address circuit 102 to select the row driver circuit 108 associated with the second row driver transistor 110*b*, whereupon the above process is repeated. The rotation of the elements continues row by row as described above until the last or Nth row of elements is rotated into the proper viewing position.

The matrix shown in FIG. 10 provides good illustration of the need for the diodes 66 connected as shown in FIGS. 9 and 10. Because the collector of a transistor having no base drive floats, if no diodes were used a current path could exist back through several coils to cause improper energization of a coil. For example, assume the collectors of transistors 110*a*, 110*b*, and driver 118*a* are floating. If the collector of transistor 110*m* is driven high, and the output collector of Darlington driver 124 is driven low, an improper current path exists through coils 130, 131 and 132, if no diodes exist. However, because back-biased diode 134 (diode 66 in FIG. 9) does not permit current to flow, no error occurs. The diodes could be eliminated if each element was addressed individually, although such addressing would require additional circuitry.

Although the specific drive circuit shown in FIG. 10 provides a row by row drive, those skilled in the art will recognize from the above disclosure those changes necessary to provide a column by column or other suitable drive, and the present invention is intended to encompass such alternatives.

Attention is now directed to FIG. 11*a*, which illustrates in perspective view a four-sided element 200 suitable for use with the present invention. The element is substantially similar to that shown in FIGS. 2 and 3, except that the stator 202 (only the end cap of which is shown in FIG. 11*a*) has four poles. The ring magnet associated therewith may either have one strong pole and three weaker poles of opposing polarity, or may have two poles of each polarity with poles of the same polarity being adjacent. In either embodiment four protuberances similar to those shown in FIG. 3 are provided. The latter form of magnet may be magnetized by positioning a coil longitudinally within the ring magnet, and aligning the coil between the respective protuberances associated with each pole. The magnet field sensed by the stator will then appear strongest at the two protuberances associated with each polarity, or a four-poled magnet will result.

The housing of the element 200 is comprised of a base and cover similar to that shown in FIG. 3 to permit the stator 202 and ring magnet (not shown) or other form of multi-poled magnet to be placed inside the display element 200. The faces of the display element 200 are curved, as better shown in FIG. 11*b*, to permit a first element 206 to be placed relatively close to a second element 208 while still permitting either of the elements to rotate without impinging upon the adjacent element. In this manner, the ratio of message area to total sign area is substantially improved, as well as providing a fourth viewing face for use as another dedicated display, or to provide an alternative character font. In some cases, as where the elements need not be closely packed, the curvature of the housing may not be required.

Also since four coils must be used if a current pulse drive is to be used, a fifth terminal (common) must be provided. This terminal may either be another barrel contact of the sort shown in FIG. 5, or may simply be an extension of the coil form. In the latter case the coil form itself will be used as the common, and the four coils will be connected thereto. A corresponding contact on the mounting block must also be provided.

To simplify winding of the coil form, each coil may be wound around two poles of the coil rather than just one as for the three poled embodiment shown in FIGS. 3 and 4.

Having fully described a preferred embodiment of the invention, it is to be understood that those skilled in the art will recognize numerous alternatives and equivalents which do not depart from the spirit of the invention disclosed herein and are intended to be a part thereof.

I claim:

1. A multiple position electromagnetically actuated display element comprising a stator having wound thereon at least three but less than five individually addressable coils, each of said coils being adapted for connection to a source of electrical energy, a housing having a plurality of faces, the number of faces being equal to the number of said coils wound on said stator, said housing being configured to substantially enclose said stator and being rotatably affixed to said stator, magnetic means having a plurality of poles, the number of said poles being equal to the number of said coils on said stator, said magnetic means being configured to be affixed to said housing in such a manner that said poles are disposed circumferentially about said stator, the spacing between said poles corresponding to the spacing between said coils on said stator so that when one of said coils is energized, the corresponding pole of said magnetic means is attracted thereto, causing said magnetic means and said housing to rotate to place one of said faces of said housing in a display position.

2. The combination of a plurality of elements as claimed in claim 1 wherein said plurality of elements is arranged in a matrix of rows and columns.

3. The combination of claim 2 further including drive circuitry for selectively addressing either one of said rows or one of said columns to cause the display elements therein to rotate to display a selected face.

4. A multiple position electromagnetically actuated display element comprising a stator having wound thereon at least three but less than five individually addressable coils, each of said coils being adapted for connection to a source of electrical energy including drive circuitry, said stator further including a coil form and a pair of end caps, each end cap including a plurality of connecting means, each connecting means being configured for electrical connection between said coils and said drive circuitry, a housing having a plurality of faces, the number of faces being equal to the number of said coils wound on said stator, said housing being configured to substantially enclose said stator and being rotatably affixed to said stator, and magnetic means having a plurality of poles, the number of said poles being equal to the number of said coils on said stator, said magnetic means being configured to be affixed to said housing in such a manner that said poles are disposed circumferentially about said stator, the spacing between said poles corresponding to the spacing between said coils on said stator so that when one of said coils is energized, the corresponding pole of said magnetic means is attracted thereto, causing said magnetic means and said housing to rotate to place one of said faces of said housing in a display position.

5. The display element of claim 4 wherein at least some of said connecting means includes a unidirectional current flow device for causing said coils to be individually addressable.

6. The display element of claim 5 wherein said connecting means is a barrel contact with a diode electrically connected thereto.

7. The display element of claim 4 further including mounting block means for connection to said end caps of said stator to maintain said stator stationary while permitting said housing to rotate thereabout.

8. The display element of claim 7 wherein said mounting block means includes a plurality of electrically conductive clips for maintaining said stator stationary and for providing electrical connectors to said coils.

9. The display element of claim 7 wherein said mounting block means provides means for supporting a plurality of said stators spaced to permit each of the housings associated therewith to rotate about the respective stators.

10. A matrix display suitable for displaying characters and messages comprising mounting means including clip means, a plurality of display elements, each display element comprising a stator, a magnet and a housing, said stator including a pair of end caps, a coil form and a plurality of coils, said coils being wound on said coil form and the terminals of each of said coils being connected to said end caps, said magnet has a plurality of poles, the number of said poles being equal to the number of said coils, said magnet being configured to be disposed about said stator and supported with said housing such that the spacing between said poles coincides with the spacing between said coils, and said housing substantially encloses said magnet and said stator, but leaving said end caps exposed for connection to said clip means included in said mounting means, said housing being rotatable about said stator when said stator is connected to said mounting means, said plurality of elements being disposed in a matrix of rows and columns to display characters.

11. The matrix display of claim 10 wherein each clip means of said mounting means is electrically conductive and said end caps of each display element include electrically conductive contacts for connection to said clip means, said electrically conductive contacts being connected to said coils and said clip means being adapted for connection to a drive circuit.

12. The matrix display of claim 12 wherein at least some of said electrically conductive contacts on said end caps of each element includes a diode.

13. A display element comprising a stator having a coil form and a pair of end caps affixed thereto, each end cap including a hub, a magnet configured to be disposed about said stator, a base having a plurality of faces, said plurality of faces being configured to enclose a portion of an assembly comprised of said stator and said magnet, said base having a circular notch at either end shaped to correspond to said hub, a cover adaped to be connected to said base, said cover having a pair of projections configured to mate to said base at each of said circular notches to enclose said stator at said hubs, said base and cover assembly substantially enclosing said stator and being rotatable thereabout when said cover is connected to said base.

14. A display element comprising a mounting block having a pair of parallel stanchions, each stanchion having on opposing faces thereabout a pair of shoulders configured to form a notch therebetween, each of said shoulders having thereon a mounting clip, said mounting clips forming a substantially V-shaped notch, a stator having a pair of end caps affixed to either end of a shaft, each of said end caps including a triangular shaped guide and a hub, a tubular contact being disposed on either side of said guide, and said guide having an apex, a housing configured to enclose said stator by being rotatably affixed to said hubs, said guides extending outward from said hubs so that an assembly of said housing and said stator may be readily mounted between said stanchions in said mounting block by causing said apex of said triangular-shaped guide to first contact said V-shaped notch formed by said mounting clips, causing said stator to rotate within said housing to align said guide with said notch such that light pressure on said housing causes said tubular contacts to connect to said mounting clips.

15. A multiple position display element suitable for use in a matrix display comprising a stator including a coil form having a plurality of coils wound thereon, and a plurality of diodes, each coil being connected to one terminal of one of said diodes to form a diode-coil combination having two ends, one of said ends being a common end and each of said ends being adapted for connection to drive circuitry, magnetic means having a plurality of poles and configured to be disposed about said stator, and a housing having a plurality of faces, said housing being configured to substantially enclose said magnet and said stator and being affixed to said stator so as to be rotatable thereabout, said magnet being fixedly positioned inside said housing such that energization of at least one of said coils causes magnetic means to be attracted thereto and causes said housing to rotate about said stator to display a selected face, said diodes being provided to ensure that only selected coils are energized.

16. The display element of claim 15 wherein said plurality of coils is equal in number to said plurality of poles on said magnet means and said faces on said housing.

17. A multiple position display element suitable for use in a matrix display comprising a stator including a coil form having a plurality of coils wound thereon, and a plurality of diodes, each coil being connected to one terminal of one of said diodes to form a diode-coil combination having two ends, one of said ends being a common end and each of said ends being adapted for connection to drive circuitry, magnetic means having a plurality of poles and configured to be disposed about said stator, said magnetic means being a ring magnet and each pole thereof comprising an inwardly extending protuberance, and a housing having a plurality of faces, said housing being configured to substantially enclose said magnet and said stator and being affixed to said stator so as to be rotatable thereabout, said magnet being fixedly positioned inside said housing such that energization of at least one of said coils causes magnetic means to be attracted thereto and causes said housing to rotate about said stator to display a selected face, said diodes being provided to ensure that only selected coils are energized.

18. The display element of claim 17 wherein said stator further includes a pair of end caps, one of said end caps being affixed to either end of said coil form, said diodes being located on said end caps.

19. The display element of claim 18 wherein said housing is affixed to said stator at said end caps.

20. The display element of claim 19 wherein said housing has three faces.

21. The display element of claim 19 wherein said housing has four faces.

22. The display element of claim 19 wherein a portion of said end caps protrudes from said housing, said protruding portion of said end caps having thereon a plurality of tubular contacts, said common end of all of said diode-coil combinations being connected to one of said contacts, and each remaining end of said diode-coil combinations being connected to a different one of the remaining contacts.

23. A display comprising a plurality of display elements arranged into columns and rows, each element house in a mounting block and comprising an energizeable, stationary stator affixed to said mounting block and a housing rotatably affixed to said stator, said housing having at least three and less than five faces and including a magnet fixed therein for rotation about said stator, and electrical drive circuitry for selectively addressing said columns and rows to cause said stators of selected elements to be energized to rotate a selected face of said housing of each of said display elements into a viewing position, a plurality of said elements being used to forms characters.

24. The display of claim 23 further including diode means for selectively rotating said display elements to display characters.

25. A multiple position electromagnetically actuated display element comprising a stator having wound thereon a plurality of individually addressable coils, each of said coils being adapted for connection to a source of electrical energy, a housing having a plurality of faces, the number of faces being equal to the number of said coils wound on said stator, said housing being configured to substantially enclose said stator and being rotatably affixed to said stator, permanent magnet means having one pole of a first polarity and a plurality of poles of the opposite polarity, the total number of poles being equal to the number of said coils on said stator, said permanent magnet means being configured to be affixed to said housing in such a manner that said poles are disposed about said stator so that when one of said coils is energized, a corresponding pole of said permanent magnet means is attracted thereto, causing said permanent magnet means and said housing to rotate to place one of said faces of said housing in a display position.

26. The display element of claim 25 wherein said stator includes diodes for causing said coils to be individually addressable.

27. The display element of claim 25 wherein a predetermined nonuniform air gap exists between said permanent magnet means and said stator.

* * * * *